US009275810B2

(12) United States Patent
Pance et al.

(10) Patent No.: US 9,275,810 B2
(45) Date of Patent: Mar. 1, 2016

(54) KEYBOARD ILLUMINATION

(75) Inventors: Aleksandar Pance, Saratoga, CA (US); Brett Bilbrey, Sunnyvale, CA (US)

(73) Assignee: Apple Inc., Cupertino, CA (US)

( * ) Notice: Subject to any disclaimer, the term of this patent is extended or adjusted under 35 U.S.C. 154(b) by 225 days.

(21) Appl. No.: 12/839,281

(22) Filed: Jul. 19, 2010

(65) Prior Publication Data

US 2012/0012448 A1 Jan. 19, 2012

(51) Int. Cl.

| | |
|---|---|
| ***H01H 13/83*** | (2006.01) |
| ***H01H 13/702*** | (2006.01) |
| ***H01H 13/785*** | (2006.01) |
| *H01H 3/12* | (2006.01) |
| *H01H 9/18* | (2006.01) |

(52) U.S. Cl.

CPC ..... *H01H 13/83* (2013.01); *H01H 3/125* (2013.01); *H01H 2009/186* (2013.01); *H01H 2009/187* (2013.01); *H01H 2209/038* (2013.01); *H01H 2219/037* (2013.01); *H01H 2219/046* (2013.01); *H01H 2229/02* (2013.01); *Y10T 29/49155* (2015.01)

(58) Field of Classification Search

CPC .... H01H 13/83; H01H 13/702; H01H 13/785
USPC ..... 200/5 A, 308, 310–314, 341, 510–514; 341/22; 345/168
See application file for complete search history.

(56) References Cited

U.S. PATENT DOCUMENTS

| | | | |
|---|---|---|---|
| 3,060,790 | A | 10/1962 | Ward |
| 3,754,209 | A | 8/1973 | Molloy et al. |
| 4,855,740 | A | 8/1989 | Muramatsu et al. |
| 5,040,479 | A | 8/1991 | Thrash |
| 5,256,913 | A | 10/1993 | Sommer |
| 5,317,105 | A | 5/1994 | Weber |
| 5,342,991 | A | 8/1994 | Xu et al. |

(Continued)

FOREIGN PATENT DOCUMENTS

| | | |
|---|---|---|
| CN | 201185147 | 1/2009 |
| EP | 1566686 | 8/2005 |

(Continued)

OTHER PUBLICATIONS

Author Unknown, "Electronic Polymers, Semiconducting Polymers and Light Emitting Polymers—Focus of Polythiophene," Azom.com, http://www.azom.com/details.asp?ArticleID=2772, at least as early as Dec. 1, 2005.

(Continued)

*Primary Examiner* — Amy Cohen Johnson
*Assistant Examiner* — Marina Fishman
(74) *Attorney, Agent, or Firm* — Brownstein Hyatt Farber Schreck, LLP

(57) ABSTRACT

Methods and apparatuses disclosed herein relate to backlit visual display elements. One embodiment may take the form a keyboard including at least one keycap, a dome switch layer underlying the keycap, and an encapsulation layer underlying the dome switch layer. The encapsulation layer may include a first printed circuit layer configured to transmit a signal corresponding to the at least one keycap. The keyboard may further include a light emissive layer underlying the encapsulation layer. The light emissive layer may include at least one emissive area corresponding to the at least one keycap and a second printed circuit layer configured to supply a voltage to the at least one emissive area.

18 Claims, 10 Drawing Sheets

(56) References Cited

U.S. PATENT DOCUMENTS

| | | | | |
|---|---|---|---|---|
| 5,406,071 | A | 4/1995 | Elms | |
| 5,456,955 | A | 10/1995 | Muggli | |
| 5,770,898 | A | 6/1998 | Hannigan et al. | |
| 5,975,953 | A | 11/1999 | Peterson | |
| 6,180,048 | B1 | 1/2001 | Katori | |
| 6,347,882 | B1 | 2/2002 | Vrudny et al. | |
| 6,416,196 | B1 | 7/2002 | Lemarchand et al. | |
| 6,545,668 | B1 | 4/2003 | Hayama | |
| 6,654,174 | B1 | 11/2003 | Huang | |
| 6,713,672 | B1 | 3/2004 | Stickney | |
| 6,724,370 | B2 | 4/2004 | Dutta et al. | |
| 6,762,381 | B2 | 7/2004 | Kunthady et al. | |
| 6,770,212 | B2 | 8/2004 | Hayashizaki | |
| 6,797,902 | B2 | 9/2004 | Farage et al. | |
| 6,800,805 | B2 | 10/2004 | Deguchi | |
| 6,806,815 | B1 * | 10/2004 | Kaikuranta et al. | 200/310 |
| 6,834,294 | B1 | 12/2004 | Katz | |
| 6,879,317 | B2 | 4/2005 | Quinn et al. | |
| 6,998,594 | B2 | 2/2006 | Gaines et al. | |
| 7,001,060 | B1 | 2/2006 | Kimura | |
| 7,008,090 | B2 | 3/2006 | Blank | |
| 7,019,242 | B2 * | 3/2006 | Kim | 200/514 |
| 7,053,799 | B2 | 5/2006 | Yu et al. | |
| 7,067,753 | B1 | 6/2006 | Cheng et al. | |
| 7,088,261 | B2 | 8/2006 | Sharp et al. | |
| 7,109,465 | B2 | 9/2006 | Kok et al. | |
| 7,133,030 | B2 | 11/2006 | Bathiche | |
| 7,161,587 | B2 | 1/2007 | Beck et al. | |
| 7,221,332 | B2 * | 5/2007 | Miller et al. | 345/32 |
| 7,223,008 | B2 | 5/2007 | Henriet | |
| 7,236,154 | B1 | 6/2007 | Kerr et al. | |
| 7,281,837 | B2 | 10/2007 | Yue et al. | |
| 7,283,066 | B2 * | 10/2007 | Shipman | 341/22 |
| 7,315,908 | B2 | 1/2008 | Anderson | |
| 7,326,154 | B2 | 2/2008 | Foley | |
| 7,329,998 | B2 | 2/2008 | Jungwirth | |
| 7,364,339 | B2 | 4/2008 | Park | |
| 7,414,213 | B2 | 8/2008 | Hwang et al. | |
| 7,417,624 | B2 | 8/2008 | Duff | |
| 7,446,303 | B2 | 11/2008 | Maniam et al. | |
| 7,453,441 | B1 | 11/2008 | Iorfida et al. | |
| 7,470,862 | B2 | 12/2008 | Lin et al. | |
| 7,470,866 | B2 | 12/2008 | Dietrich et al. | |
| 7,473,139 | B2 | 1/2009 | Barringer et al. | |
| 7,501,960 | B2 | 3/2009 | Price et al. | |
| 7,557,312 | B2 | 7/2009 | Clark et al. | |
| 7,557,690 | B2 | 7/2009 | McMahon | |
| 7,582,839 | B2 | 9/2009 | Kyowski et al. | |
| 7,598,686 | B2 | 10/2009 | Lys et al. | |
| 7,692,111 | B1 | 4/2010 | Rosing et al. | |
| 7,710,369 | B2 | 5/2010 | Dowling | |
| 7,712,910 | B2 | 5/2010 | Ng et al. | |
| 7,750,282 | B2 | 7/2010 | Mahowald et al. | |
| 7,750,352 | B2 | 7/2010 | Thurk | |
| 7,769,353 | B2 | 8/2010 | Dietrich et al. | |
| 7,778,590 | B2 | 8/2010 | Kogo | |
| 7,825,907 | B2 | 11/2010 | Choo et al. | |
| 7,825,917 | B2 | 11/2010 | Bryant et al. | |
| 7,845,953 | B2 | 12/2010 | Brock et al. | |
| 7,863,822 | B2 | 1/2011 | Stoschek et al. | |
| 7,880,131 | B2 | 2/2011 | Andre et al. | |
| 7,960,682 | B2 | 6/2011 | Gardner, Jr. | |
| 7,968,835 | B2 | 6/2011 | Tsai | |
| 8,017,216 | B2 | 9/2011 | Kato et al. | |
| 8,018,170 | B2 | 9/2011 | Chen et al. | |
| 8,080,753 | B2 | 12/2011 | Yeh et al. | |
| 8,160,562 | B2 | 4/2012 | Yuki et al. | |
| 8,174,304 | B2 | 5/2012 | Cheng et al. | |
| 8,217,285 | B2 | 7/2012 | Chang | |
| 8,217,887 | B2 | 7/2012 | Sangam et al. | |
| 8,232,958 | B2 | 7/2012 | Tolbert | |
| 8,247,714 | B2 * | 8/2012 | Tsai | 200/5 A |
| 8,282,261 | B2 | 10/2012 | Pance et al. | |
| 8,303,151 | B2 | 11/2012 | Pance et al. | |
| 8,373,355 | B2 | 2/2013 | Hoover | |
| 8,378,857 | B2 | 2/2013 | Pance et al. | |
| 8,378,972 | B2 | 2/2013 | Pance et al. | |
| 8,785,796 | B2 | 7/2014 | Bronstein et al. | |
| 2001/0053082 | A1 * | 12/2001 | Chipalkatti et al. | 362/496 |
| 2003/0174072 | A1 | 9/2003 | Salomon | |
| 2003/0210221 | A1 | 11/2003 | Aleksic | |
| 2004/0032745 | A1 | 2/2004 | Pederson | |
| 2004/0230912 | A1 | 11/2004 | Clow et al. | |
| 2004/0238195 | A1 | 12/2004 | Thompson | |
| 2004/0239618 | A1 | 12/2004 | Kim | |
| 2005/0073446 | A1 | 4/2005 | Lazaridis et al. | |
| 2006/0022951 | A1 | 2/2006 | Hull | |
| 2006/0158353 | A1 | 7/2006 | Tseng | |
| 2006/0227085 | A1 | 10/2006 | Boldt et al. | |
| 2007/0046646 | A1 | 3/2007 | Kwon et al. | |
| 2008/0001787 | A1 | 1/2008 | Smith et al. | |
| 2008/0127537 | A1 | 6/2008 | Boisseau | |
| 2008/0143560 | A1 | 6/2008 | Shipman | |
| 2008/0166006 | A1 | 7/2008 | Hankey et al. | |
| 2008/0291159 | A1 | 11/2008 | Wang | |
| 2008/0303918 | A1 | 12/2008 | Keithley | |
| 2009/0135142 | A1 | 5/2009 | Fu et al. | |
| 2009/0201179 | A1 | 8/2009 | Shipman et al. | |
| 2009/0277763 | A1 | 11/2009 | Kyowski et al. | |
| 2010/0008030 | A1 | 1/2010 | Weber et al. | |
| 2010/0044067 | A1 | 2/2010 | Wong et al. | |
| 2010/0238120 | A1 | 9/2010 | Hsieh | |
| 2010/0265181 | A1 | 10/2010 | Shore | |
| 2010/0300856 | A1 | 12/2010 | Pance et al. | |
| 2010/0301755 | A1 | 12/2010 | Pance et al. | |
| 2010/0302169 | A1 | 12/2010 | Pance et al. | |
| 2010/0306683 | A1 | 12/2010 | Pance et al. | |
| 2011/0280042 | A1 | 11/2011 | Pance et al. | |
| 2011/0304485 | A1 | 12/2011 | Mahowald et al. | |
| 2012/0013490 | A1 | 1/2012 | Pance | |
| 2012/0262940 | A1 | 10/2012 | Miyairi et al. | |
| 2013/0093330 | A1 | 4/2013 | Pance | |
| 2013/0163223 | A1 | 6/2013 | Pance | |
| 2013/0201111 | A1 | 8/2013 | Pance et al. | |
| 2013/0256108 | A1 | 10/2013 | Mahowald et al. | |
| 2014/0225835 | A1 | 8/2014 | Pance et al. | |

FOREIGN PATENT DOCUMENTS

| | | |
|---|---|---|
| EP | 1881513 | 1/2008 |
| EP | 2017694 | 1/2009 |
| GB | 2431001 | 4/2007 |
| JP | 60004094 | 1/1985 |
| JP | 3106701 | 11/2004 |
| KR | 10-2008-0102954 | 11/2008 |
| KR | 100870113 | 11/2008 |
| WO | WO2007/002796 | 1/2007 |
| WO | WO2007/102633 | 9/2007 |
| WO | WO2009/136929 | 11/2009 |

OTHER PUBLICATIONS

Author Unknown, "Long Polymers Light Up LEDs," Physicsweb.org, http://www.physicsweb.org/articles/news/6/4/22/1, at least as early as Apr. 30, 2002.

Author Unknown, "Optimus Keyboard," Art.Lebedev Studio, http://www.artlebedev.com/portfolio/optimus/, at least as early as Dec. 1, 2005.

Author Unknown, "Optimus OLED Keyboard," Gizmodo: The Gadgets Weblog, http://www.gizmodo.com/gadgets/peripherals/input/optimus-oled-keyboard-112517.php, at least as early as Dec. 1, 2005.

Author Unknown, "Optimus OLED Keyboard with Customizable Layout," Gear Live, http://www.gearlive.com/index.php/news.article/optimus_oled_keyboard_07131058/, at least as early as Dec. 1, 2005.

Author Unknown, "Optimus Russian Keyboard," Primo Tech, http://www.primotechnology.com/index.php?art+articles/0705/optimus/index.htm, at least as early as Dec. 1, 2005.

Author Unknown, "Organic Light-Emitting Diode," Wikipedia.com, http://en.wikipedia.org/wiki/OLED, at least as early as Dec. 1, 2005.

Author Unknown, "Organic Polymers to Precede Nano Semi," EETimes.com, http://www.eet.com/story/OEG20030923S0055, at least as early as Dec. 1, 2005.

(56) References Cited

OTHER PUBLICATIONS

Author Unknown, "How, Why & Where to Use Self-Clinching Fasteners," PennEngineering, http://www.pemnet.com/fastening_products/about_self_clinching/index.html, 2 pages, at least as early as Dec. 21, 2011.

Author Unknown, "Physics News Update," American Institute of Physics, http://www.aip.org/pnu/1993/split/pnu1148-3.htm, Oct. 19, 1993.

Author Unknown, "Polymer Light-Emitting Diodes," Philips Research—Technologies, http://www.research.philips.com/technologies/display/polyled/polyled/, at least as early as Dec. 1, 2005.

Author Unknown, "What is OLED (Organic Light Emitting Diode)?," WiseGeek.com, http://www.wisegeek.com/what-is-an-oled.htm?referrer+adwords_campaign=oled_ad=024 . . . , at least as early as Dec. 1, 2005.

Author Unknown, "What is PLED?—A Word Definition from the Webopedia Computer Dictionary," http://www.webopedia.com/TERM/P/PLED/html, at least as early as Dec. 1, 2005.

Braun et al., "Transient Repsonse of Passive Matrix Polymer LED Displays," http://www.ee.calpoly.edu/~dbraun/papers/ICSM2000BraunEricksonK177.html, at least as early as Dec. 1, 2005.

Rojas, "Optimus Keyboard Trumped by the Display Keyboard?," http://www.engadget.com/2005/07/29/optimus-keyboard-trumped-by-the-display-keyboard/, Jul. 29, 2005.

* cited by examiner

KEYBOARD ILLUMINATION

BACKGROUND

I. Technical Field

Embodiments relate generally to visual displays, and more particularly to illuminated input devices that can be selectively or fully illuminated.

II. Background Discussion

Electronic devices are ubiquitous in society and can be found in everything from household appliances to computers. Many electronic devices include visual display elements that can be selectively or fully illuminated by a light source, often through backlighting. For example, many electronic devices include keyboards or keypads that can be backlit to allow a user to interact with the device in low light settings. Other electronic devices may be configured to illuminate an associated keyboard or keypad for purely aesthetic purposes.

While providing an attractive backlight for a user is useful in many electronic devices, much of the aesthetic and practical appeal of a device can quickly be compromised if the light source does not transmit enough light to be adequately perceived by a user. Additionally, the light source required for many visual display elements can quickly drain the power source of the electronic device. This may be a problem, for example, when the electronic device is running on battery power or some other depletable power source. Likewise, uneven or inadequate lighting may further detract from the aesthetic appeal or functional aspects of a device.

Although many designs for providing illuminated visual display elements on electronic and personal devices have generally worked well in the past, there is a desire to provide new and improved designs or techniques that result in even more aesthetically pleasing and power-efficient visual display elements. In particular, the ability to provide visual display elements on electronic and personal devices in a manner that can generate a sufficient amount of light to fulfill a purpose while conserving space and power is desirable.

SUMMARY

Methods and apparatuses disclosed herein relate to backlit keyboards and keypads. One embodiment may take the form of a backlit keyboard that includes a light emissive layer having emissive areas that transmit light through the keycap in an upward direction. In some embodiments, the light emissive layer may include an organic light-emitting diode light source. The emissive areas may be formed by depositing light-emitting polymers onto the surface of a substrate layer. In one embodiment, the substrate layer may be transparent or semi-transparent so that light transmitted by the emissive areas is not blocked. In some embodiments, an encapsulation layer may further include a printed circuit layer for transmitting command signals to the processing unit of an electronic device upon actuation of the keycaps.

Some embodiments may take the form a keyboard including at least one keycap, a dome switch layer underlying the keycap, and an encapsulation layer underlying the dome switch layer. The encapsulation layer may include a first printed circuit layer configured to transmit a signal corresponding to the at least one keycap. The keyboard may further include a light emissive layer underlying the encapsulation layer. The light emissive layer may include at least one emissive area corresponding to the at least one keycap and a second printed circuit layer configured to supply a voltage to the at least one emissive area.

Other embodiments may take the form of a method for manufacturing a light emissive layer for illuminating a keyboard. The method may include depositing a light-emitting polymer onto a first layer to form an emissive area and forming a first circuit on a second layer. The first circuit may be configured to transmit a signal corresponding to a keycap. The method may further include forming a second circuit on the first layer. The second circuit may be configured to supply a voltage to the emissive area.

Still other embodiments may take the form of a keyboard including at least one keycap and a light emissive layer underlying the at least one keycap. The light emissive layer may include at least one emissive area covering only a portion of the light emissive layer and corresponding to the at least one keycap. The keyboard may further include a dome switch layer underlying the light emissive layer.

This summary is provided to introduce a selection of concepts in a simplified form that are further described herein. This summary is not intended to identify key features or essential features of the claimed subject matter, nor is it intended to be used to limit the scope of the claimed subject matter. Other features, details, utilities, and advantages will be apparent from the following more particular written description of various embodiments, as further illustrated in the accompanying drawings and defined in the appended claims.

BRIEF DESCRIPTION OF THE DRAWINGS

The use of the same reference numerals in different drawings indicates similar or identical items.

DETAILED DESCRIPTION

Embodiments described herein relate to light-transmissive and power-efficient input elements. In particular, certain input elements can take the form of a fully or partially backlit keyboard, individual keys, or a keypad. Sample input devices may be used in conjunction with (or form part of) an electronic device, such as a personal computer (including laptop computers, handheld computing devices, and desktops), computers, televisions, media players, mobile telephones, personal digital assistants (PDA), household and commercial appliances, and so on and so forth.

One embodiment may be a backlit key on a keyboard. The key may include a light emissive layer having emissive areas operative to transmit light in an upward direction and through a keycap. In some embodiments, the light emissive layer may include or be coupled to a light source such as an organic light-emitting diode (OLED). One or more emissive areas may be formed by depositing a light-emitting polymer onto the surface of a substrate layer. In one embodiment, the substrate layer may be transparent or semi-transparent so that light transmitted by the emissive areas is not fully blocked. In some embodiments, the keyboard may include an encapsulation layer including a printed circuit layer for transmitting command signals to the processing unit of an electronic device upon actuation of the keycaps.

Figure 1:
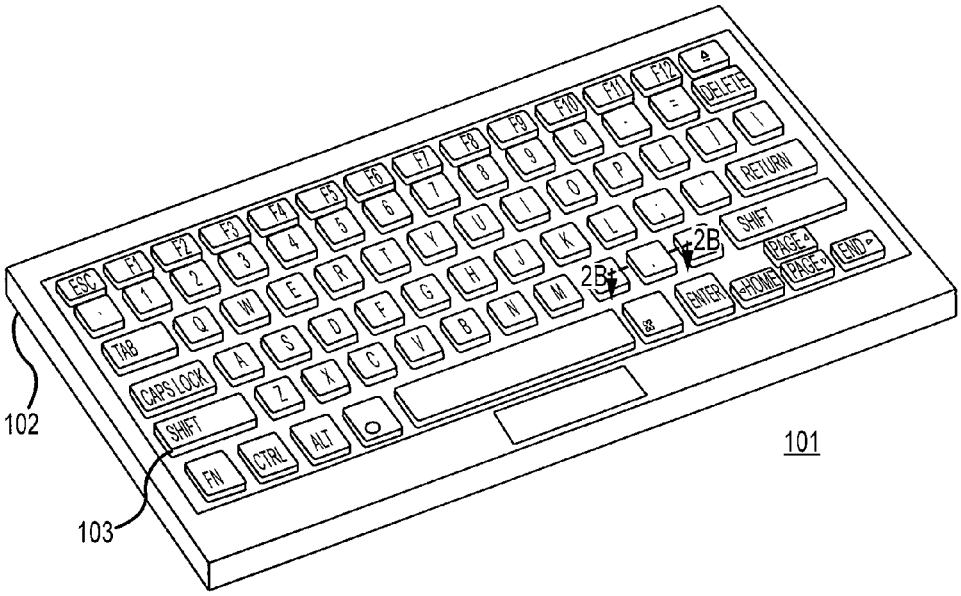
FIG. 1 illustrates a side perspective view of a laptop computer in an open position and having an illuminated keyboard.

FIG. 1 is a perspective view of an example of an illuminated keyboard 101. The keyboard could be part of a laptop, a standalone keyboard, a desktop computer system, a docking station, and so on. The keyboard 101 may have one or more keys 103 and a housing 102 for fully or partially encasing the electronic and mechanical components of the keyboard 101. As will be further described below, one or more of the keys 103 may be illuminated using a light source (shown in FIGS. 2A-3 and discussed below) that is positioned behind the keys 103. In some embodiments, the light source may be full or partially encased by the housing 102 of the keyboard 101.

Figure 2A:
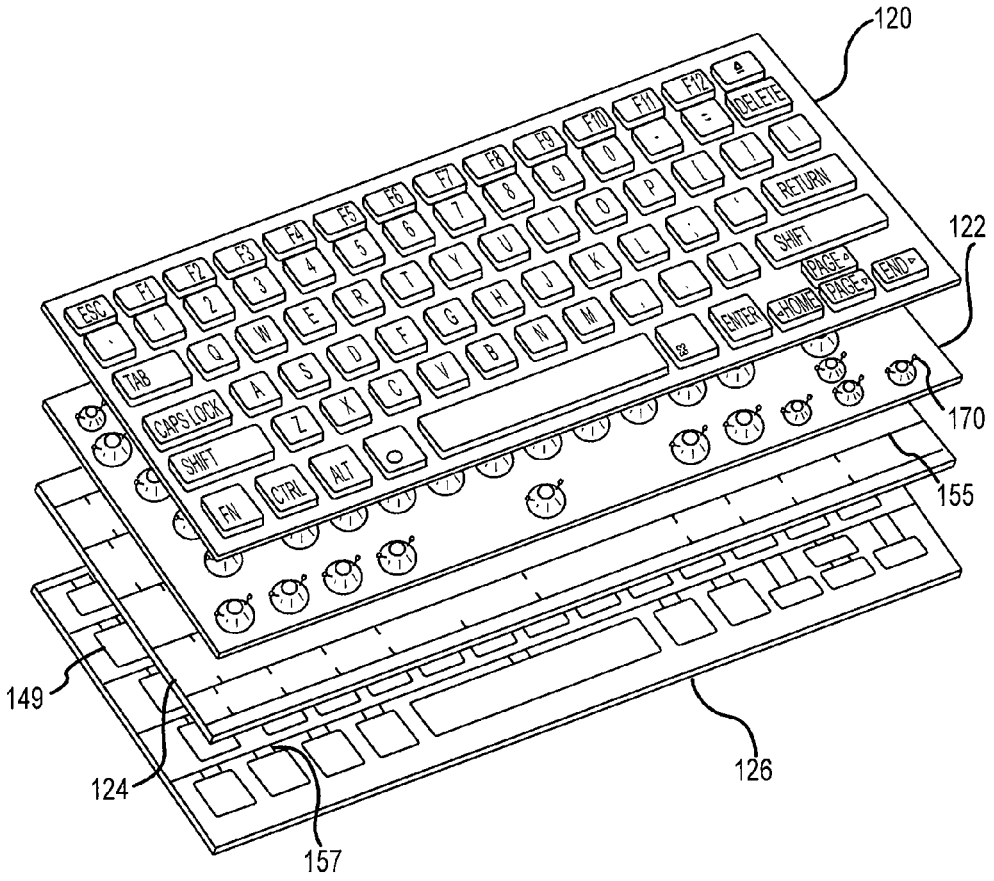
FIG. 2A illustrates an exploded side perspective view of the illuminated keyboard of FIG. 1.

FIG. 2A illustrates an exploded view of the keyboard 101 shown in FIG. 1. As shown in FIG. 2A, the keyboard 101 may include a key layer 120, a dome switch layer 122, an encapsulation layer 124, and a light emissive layer 126. In one embodiment, the dome switch layer 122 may be positioned underneath the key layer 120, the light emissive layer 126 may be positioned underneath the dome switch layer 122, and the encapsulation layer 124 may be positioned above the light emissive layer 126. However, other embodiments may have different configurations. For example, as will be further described below, the encapsulation and light emissive layers 124, 126 may be positioned above the done switch layer 122.

Figure 2B:
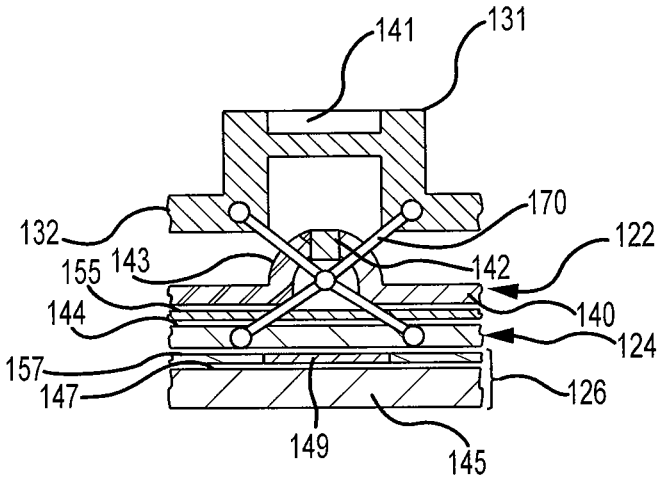
FIG. 2B illustrates a closeup and cutaway side cross-sectional view of a keycap of the illuminated keyboard of FIG. 1, as taken along line 2B-2B of FIG. 1.

In one embodiment, the key layer 120 may include a plurality of keycaps 132. One example of a keycap 132 is shown in a cutaway side cross-sectional view in FIG. 2B. As shown in FIG. 2B, a legend 141 or graphic may be etched onto the top outermost surface 131 of the keycaps 132. The legend 141 or graphic may correspond to a command that may be executed by the processing unit of the electronic device when the keycap 132 is depressed. In one embodiment, the legend 141 may be etched using a computer-numerical controlled laser etching technique for removing layers of material from the outermost keycap surface 131. The laser etching process may remove enough material from the keycap 132 surfaces so that light is permitted to pass through the etched portions, thereby illuminating the legend 141. In other embodiments, the legend 141 may be mechanically or otherwise engraved. In further embodiments, the legend may be painted or otherwise deposited onto the surface of the keycap. The legend 141 may have any shape or design that may include, but is not limited to, alphabetic characters, punctuation symbols, numbers, and so on and so forth. As will be further described below, the legends 141 on the keycaps 132 may be selectively or fully backlit using the light emissive layer 126.

The term "horizontal" as used herein is defined as a plane parallel to the top outermost surface 131 of the keycaps 132, regardless of its orientation. The term "vertical" refers to a direction perpendicular to the horizontal direction just defined. Terms such as "above," "below," "up," "down," "bottom," "top," "side," "higher," "lower," "upper," "over," and "under" are defined with respect to the horizontal plane.

In some embodiments, the keycaps 132 may be inserted through appropriately-sized openings defined in the keyboard housing. In other embodiments, the keycaps may be inserted through openings defined by a key plate provided underneath the keyboard housing. However, in further embodiments, the keycaps 132 may not be extended through openings, but may be part of the keyboard housing. The keycaps 132 may be unattached to one another or connected via a membrane that extends between the keycaps 132.

The dome switch layer 122 may include a flexible membrane 140 and a plurality of dome-shaped protrusions 143 terminating in switches 142 that may be downwardly depressed to contact a first wiring layer 155 (as shown in FIGS. 2B-2E and further described below) deposited on the encapsulation layer 124. When the switch 142 makes contact with the first wiring layer 155, a circuit corresponding to a specific keycap 132 may be closed and a signal may be transmitted to the processing unit of the electronic device. In contrast, when the switch 142 is not in contact with the first wiring layer 155, the circuit corresponding to the keycap 132 may be left open. Each of the switches 142 in the keyboard 101 may correspond to a specific keycap 132 so that a keyboard user may depress the keycaps 132 either individually or in combination with other keycaps to transmit various command signals to the processing unit of the electronic device.

In one embodiment, the membrane 140 may be formed from a non-conductive flexible material. For example, the membrane 140 may be formed from a flexible polymeric material, such as rubber or silicone. The switches 142 may be formed from any conductive material, such as a metal or polyester. In some embodiments, the membrane 140 and the switches 142 may be formed from different materials. However, in other embodiments, the membrane 140 and switches 142 may be formed from the same material. For example, in one embodiment, the membrane 140 and switches 142 may both be formed from rubber, with the switch 142 being doped in a metallic substance that conducts electricity.

In some embodiments, the dome switch layer 122 may further include multiple scissor-switches 170 that may be attached to the keycaps 132. In one embodiment, the scissor switches 170 may include two plastic pieces that interlock in a crossed or "scissor"-like fashion. The scissor switches may engage a plunger that depresses the switches 142 toward the first wiring layer 155 to complete the circuit corresponding to the keycap 132. Generally, the scissor-switches may allow for a shorter key travel distance, and may further extend the life span of the keyboard by reducing side-to-side movement of the keycap 132 when depressed. Other embodiments may include a dome switch layer that does not utilize a scissor-switch mechanism.

As shown in FIGS. 2A and 2B, a light emissive layer 126 may be provided underneath or above the dome switch layer 122. In one embodiment, the light emissive layer 126 may be configured as a panel that has a planar surface. However, other embodiments may include other configurations of light emissive layers. For example, the light emissive layer 126 may be configured as a light guide panel, light tube, light pipe, optical fiber, and so on and so forth. In another embodiment, the light emissive layer 126 may be an organic light-emitting diode (OLED) display panel. In still other embodiments, the light emissive layer 126 may include or be coupled to any other type of light source, such as one or more light-emitting diodes or other light source.

Generally, an OLED is a light-emitting diode having an emissive electroluminescent layer made from an organic compound. Multiple OLEDS may be formed into or on a film of light-emitting polymers. In one embodiment, the OLED panel may be manufactured by depositing or printing the light-emitting polymers onto a substrate layer 145. When connected to a voltage source, the deposited light-emitting polymers may emit light. As will be further discussed below, the light-emitting polymers may be deposited in a predetermined pattern or configuration so as to form an emissive area 149 having a desired pattern or shape. Accordingly, when the light emissive layer 126 is connected to a supply voltage, the OLEDs in the emissive areas 149 and receiving voltage may emit light, while the other portions of the light emissive layer remain unilluminated. Suitable methods for depositing and patterning the light-emitting polymers may include, but are not limited to, organic vapor jet printing, vapor thermal evaporation, laser patterning, and so on and so forth. In one embodiment, the substrate layer 145 may be formed from a transparent or semi-transparent non-conductive or conductive material. In other embodiments, the substrate layer 145 may be formed from an opaque material. The substrate layer may be formed from any suitable material for receiving the light-emitting polymers, including, but not limited to, polyethylene terephthalate, silicon, glass, plastic, or any other suitable substrate.

In one embodiment, the OLED panel may be a passive-matrix OLED. However, in other embodiments, the OLED panel may be an active-matrix OLED. Additionally, the OLED panel may be top light-emitting, bottom light-emitting, or a combination thereof. Further, the emissive areas 149 may be transparent or semi-transparent when lit. However, in other embodiments, the emissive areas 149 may be an fully or partially opaque.

OLED panels may be used in certain circumstances where traditional display devices are unsuitable or encounter issues. OLED panels do not require a backlight to function, and may therefore be much thinner and lighter than backlit light sources, thus resulting in a thinner and lighter keyboard construction. Additionally, a single OLED panel is capable of producing multiple emissive patches as opposed to a single enlarged emissive area. OLED panels further draw a relatively small amount of power for the light produced, and therefore require less power for their operation than many backlit display devices.

As shown in FIG. 2A, the light emissive layer 126 may also include or be adjacent to a second wiring layer 157. The second wiring layer 157 may be coupled to one or more OLEDs in the emissive areas 149 of the light emissive layer 126, and may be configured to supply a voltage from a voltage source to illuminate the emissive areas 149 by activating the corresponding OLED(s).

In one embodiment, the first and second wiring layers 155, 157 may be printed circuits, in which the wires are deposited onto the encapsulation and/or substrate layers 124, 145. In other embodiments, the wires may be etched or embedded into the encapsulation and/or substrate layers 124, 145. As shown in FIG. 2B, the first wiring layer 155 may be provided on the outermost surface 144 of the encapsulation layer 124, while the second wiring layer 157 may be provided on the outermost surface 147 of the substrate layer 145. Forming the first and second wiring layers 155, 157 on the encapsulation and/or substrate layers 124, 145 may reduce the need for additional circuitry between the light emissive layer 126 and the keycap 120 that may block or scatter light emitted by the emissive areas 149, while also allowing for a more compact keyboard design. In other embodiments, the first and/or second wiring layers 155, 157 may be provided on other layers of the keyboard. Additionally, the first and second wiring layers 155, 157 may be provided on the same layer. For example, the first and second wiring layers 155, 157 may both be provided on the substrate layer or on the encapsulation layer.

The first and second wiring layers 155, 157 may have any suitable wire configuration for connecting the OLEDs and/or dome switches 142 when depressed. For example, the first and second wiring layers 155, 157 may include a plurality of wire rows corresponding to each row of the keyboard, as well as a plurality of wires extending in a direction perpendicular to the rows. Other examples may have different configurations. For example, other embodiments may include wire columns corresponding to each column of the keyboard and wires extending in a direction perpendicular to the columns.

As shown in FIGS. 2A and 2B, an encapsulation layer 124 may be provided above the light emissive layer 126. The encapsulation layer 124 may serve to form a wall above at least a portion of the light emissive layer 126 so that the light-emitting polymers forming the emissive areas 149 of the OLED are protected and insulated between the substrate and encapsulation layers 145, 124. In one embodiment, the encapsulation layer 124 may be a rigid or semi-rigid planar sheet that further reinforces the structure of the keyboard 101. The encapsulation layer 124 may also define mounting holes or structures for receiving the scissor-switches 170 that may be attached to the keycaps 132. However, in other embodiments, the scissor-switches 170 may be mounted to another layer of the keyboard, such as to the substrate layer 145. The encapsulation layer 124 may be formed from any suitable substrate, such as glass, polyethylene terephthalate, an elastomer, and so on and so forth. In some embodiments, the encapsulation layer 124 and the substrate layer 145 may be formed from the same material. However, in other embodiments, the encapsulation and substrate layers may be formed from different materials.

Figure 2C:
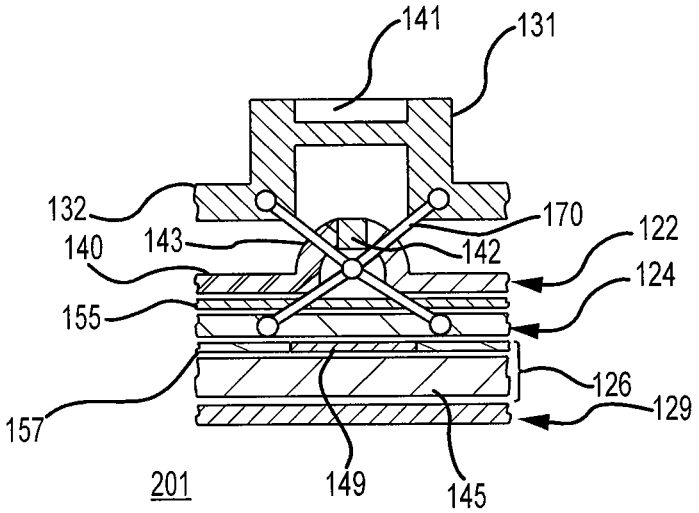
FIG. 2C illustrates a closeup and cutaway side cross-sectional view of a keycap of another embodiment of an illuminated keyboard, as taken along line 2B-2B of FIG. 1.
Figure 2D:
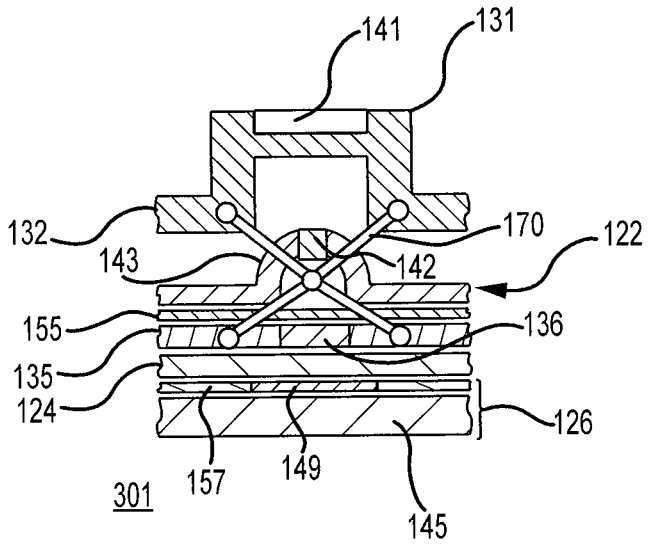
FIG. 2D illustrates a closeup and cutaway side cross-sectional view of a keycap of another embodiment of an illuminated keyboard, as taken along line 2B-2B of FIG. 1.

Another embodiment may further include an optional metal layer that is positioned underneath the light emissive layer 126. One implementation of this embodiment is shown in FIG. 2C, illustrating a partial cross-sectional view of another embodiment of a keyboard 201 that includes a planar metal sheet 129. The planar metal sheet 129 may provide further structural support and rigidity to the keyboard 101 as the keycaps 132 are depressed. In one embodiment, the metal sheet 129 may be positioned underneath both the encapsulation layer 124 and the light emissive layer 126 so that the light emitted from the emissive areas 149 is not obstructed by the metal sheet 129. Alternatively, FIG. 2D illustrates another embodiment of a keyboard 301, in which a patterned metal sheet 135 may be positioned between the light emissive layer 126 and the keycap 132. For example, the metal sheet 131 may define multiple apertures 136 and/or include semi or fully transparent areas that are arranged in a pattern so that light from the emissive areas 149 is not blocked by the sheet. Other embodiments may use a patterned metal sheet that reflects light from the emissive areas 149 in an upward direction. In the embodiment shown in FIG. 2D, the patterned metal sheet 135 may also define mounting holes or structures for receiving the scissor-switches 170 that may be attached to the keycaps 132. However, in other embodiments, the scissor-switches 170 may be mounted to other layers of the keyboard 301, such as to the encapsulation layer 124 or the substrate layer 126.

Figure 2E:
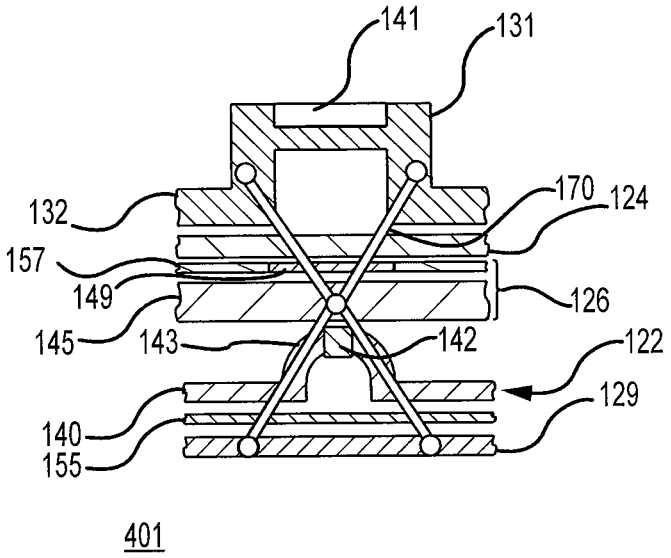
FIG. 2E illustrates a closeup and cutaway side cross-sectional view of a keycap of another embodiment of an illuminated keyboard, as taken along line 2B-2B of FIG. 1.

In some embodiments, the light emissive layer 126 may be positioned above the dome switch layer 122. One implementation of this embodiment is shown in FIG. 2E, illustrating a partial cross-sectional view of another embodiment of a keyboard 501 in which the encapsulation layer 124 and the light emissive layer 126 are positioned underneath the keycap 132 and above the dome switch layer 122. This embodiment may serve to enhance the amount of light emitted through the legend 141, since light from the emissive areas 149 is not scattered or blocked by an intervening dome switch layer 122. In one embodiment, the light emissive layer 126 may be a flexible OLED that includes flexible substrate and encapsulation layers 145, 124 that can be downwardly biased when the keycap 132 is depressed. For example, the substrate and/or encapsulation layers 145, 124 may be formed from a thin sheet of plastic, polyethylene terephthalate, fabric, and so on and so forth.

As discussed above, the dome switch layer 122 may be positioned underneath the substrate layer 145 of the light emissive layer 126. The dome switch layer 122 may be positioned above the first wiring layer 155, which may be deposited on a metal layer 129 positioned underneath the dome switch layer 122. In some embodiments, the metal layer 129 may be a rigid or semi-rigid sheet that serves to provide structural reinforcement for the keycap 132 and for the light emissive layer 125 when the keycap is depressed. The metal layer 129 may define mounting holes for receiving the scissor-switches 170 that are attached to the keycaps 132.

In contrast to existing keyboards, which include multiple layers obstructing light from the illumination source, the light emissive layer of the described embodiments may be positioned directly underneath the dome switches or on top of the dome switches, thereby enhancing the amount of light transmitted through the keycap. Accordingly, the need for additional light-enhancing features, such as microlenses and masks configured to prevent scattering, is reduced or eliminated. However, other embodiments of keyboards may include additional layers between the light emissive layer 126 and the keycap 132. For example, one embodiment may include a layer positioned above the light emissive layer 126 that includes a microlens array configured to enhance the amount of light emitted from the emissive areas 149.

Figure 3:
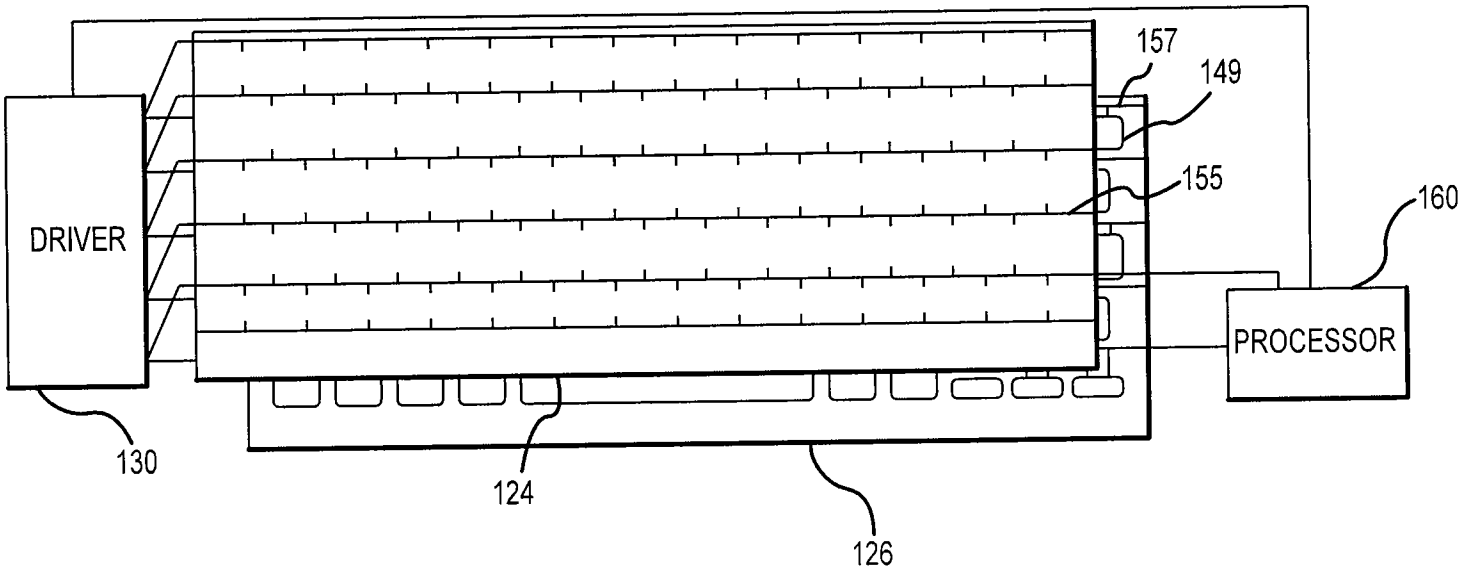
FIG. 3 illustrates a top plan view of an encapsulation layer, light emissive layer and driver of the illuminated keyboard of FIG. 1.

FIG. 3 illustrates an example of an encapsulation layer 124, light emissive layer 126, driver 130, and processing unit 160 that may be utilized in conjunction with an embodiment of the keyboard 101. As alluded to above, the light emissive layer 126 may include an OLED or multiple OLED light sources. In one embodiment, the driver 130 may be a single or multi-channel OLED driver. As shown in FIG. 3, the driver 130 may be connected to the second wiring layer 157 to supply voltage to the emissive areas 149. The driver 130 may be configured to control the voltage supplied to the light emissive layer 126 by turning the voltage supply on and off, for example, using a pulse width modulated (PWM) signal. The PWM signal may be generated within the driver 130, or alternatively, by another component within or external to the keyboard 101, such as a keyboard controller. In other embodiments, the voltage supplied to the emissive areas 149 may be from an analog source, and the voltage level may be varied, as opposed to switched on and off.

In some embodiments, the driver 130 may control the light source based on an input from a light sensor. The light sensor may be an ambient light sensor configured to sense light within the visible light spectrum. In one embodiment, the driver 130 may be configured to turn on and turn off the light source based on the amount (or brightness) of light impinging on the light sensor. The driver 130 may further be configured to dim or brighten the light source based on the reading from the light sensor. As an example, the driver may increase the frequency of the PWM signal to brighten the light source if the ambient light sensor indicates that the environment is dark or light is otherwise below a threshold.

Other embodiments may control the light source based on a battery reading, for example, to conserve battery power of the laptop or computer. In one embodiment, the driver 130 may be configured to turn on and turn off the light source based on the amount (or brightness) or level of charge of a battery. The driver 130 may further be configured to dim or brighten the light source based on the level of charge of the battery. As an example, the frequency of the PWM signal may be adjusted to dim the light source and/or turn off the light source if a power meter indicates that the battery is at a low level or otherwise below a threshold.

The processing unit 160 may be within or external to the keyboard. In some embodiments, the processing unit 160 may be a processing unit within the electronic device. For example, the processing unit may be a microprocessor or a central processing unit of a desktop computer or laptop, and the microprocessor or central processing unit may be configured to communicate with the driver 130. For example, the microprocessor may transmit control signals to the driver 130 to turn off, turn on, brighten and/or dim the light source. Alternatively, software or firmware, such as in the form of an operating system, may be configured to control the driver 130. In other embodiments, the processing unit may be provided within the keyboard housing. The processing unit 160 may be connected to the first wiring layer 155, which, as alluded to above, may be deposited on or part of the encapsulation layer 124. As discussed above, the first wiring layer 155 may be configured to transmit command signals corresponding to a depressed keycap to the processing unit 160 for processing the signal associated with the depressed key.

Figure 4A:
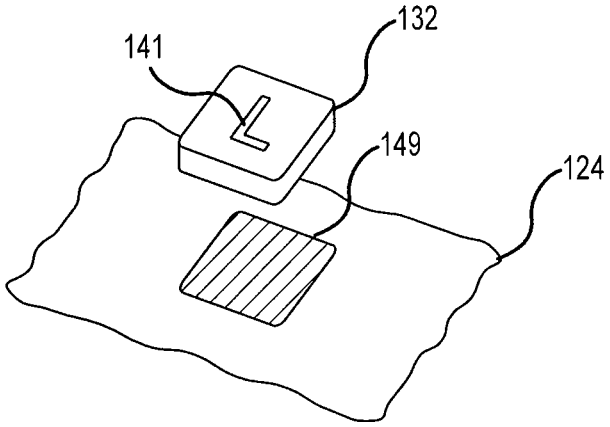
FIG. 4A illustrates an exploded side perspective view of a keycap and light emissive layer of another embodiment of an illuminated keyboard.
Figure 4B:
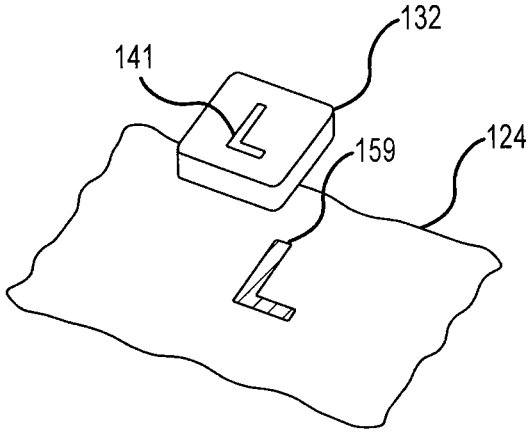
FIG. 4B illustrates an exploded side perspective view of a keycap and light emissive layer of still another embodiment of an illuminated keyboard.

FIGS. 4A and 4B illustrate, in a side-perspective view, two emissive area patterns that may be employed with different embodiments of the illuminated keyboard. In one embodiment, shown in FIG. 4A, the light emissive layer 126 may include multiple emissive areas 149. For example, the light emissive layer 126 may include one emissive area 149 per keycap 132 on the keyboard 101. In one embodiment, each emissive area 149 may have a shape that is substantially identical to the shape of the top surface of the corresponding keycap 132. For example, the space bar keycap 132 may be associated with an elongated rectangular-shaped emissive area 149, while a square letter or number keycap may correspond to a square-shaped emissive area 149. In some embodiments, each keycap 132 may be aligned with a corresponding emissive area 149 along at least one vertical axis so that light from the emissive area 149 may be directed vertically upward through all or a portion of the top surface of the keycap. In other embodiments, a single emissive area 149 may be configured to illuminate multiple keycaps 132, or may only cover a portion of the top surface of the keycaps.

As discussed above, the legends 141 may be etched to allow light to pass through the keycap 132, while the unetched portions of the keycap may be formed from or coated with a light-blocking material to block light emitted by the emissive areas 149. Accordingly, the legends 141 may fully or partially control the amount of light emitted by the keycaps 132, regardless of the shape or size of the emissive area 149 underlying the keycaps. As such, even if a particular emissive area 149 is larger than the area encompassed by the legend 141, a keyboard user may perceive the outline of the legend when the keyboard is illuminated, as opposed to the entire emissive area.

In another embodiment, shown in FIG. 4B, the emissive areas 159 may have a shape that is substantially identical to the shape of the legend 141 on a corresponding keycap 132.

For example, the emissive area 159 corresponding to a keycap 132 representing the letter "L" may have an "L" shape. In some embodiments, each keycap 132 may be aligned with a corresponding emissive area 159 along at least one vertical axis so that light from the emissive area 159 may be directed vertically upward through all or a portion of the legend 141. Accordingly, the legends may appear to be illuminated to a keyboard user when the emissive area 159 is connected to a voltage supply. In this embodiment, illumination of the keycaps 132 may be substantially confined to the legends, and light may be prevented from illuminating other portions of the keyboard, such as the edges or sides around the keycaps 132. In another embodiment, the emissive area may match the overall shape of the legend 141, but may be larger or smaller than the legend 141.

The embodiments described in FIGS. 4A and 4B may provide many significant power-saving advantages over existing keyboard configurations while enhancing the amount of light that is transmitted through the keycaps 132. For example, the smaller emissive areas require less power for their illumination than a light emissive layer with a larger total emissive area. These embodiments may also serve to reduce light scattering and diffraction, allowing for the use of a lower power light source to generate a brighter backlight. Furthermore, the alignment of the patterned emissive areas with the keycap 132 or legend 141 may enhance the uniformity of light distribution from the keycap, as perceived by a keyboard user.

Figure 5:
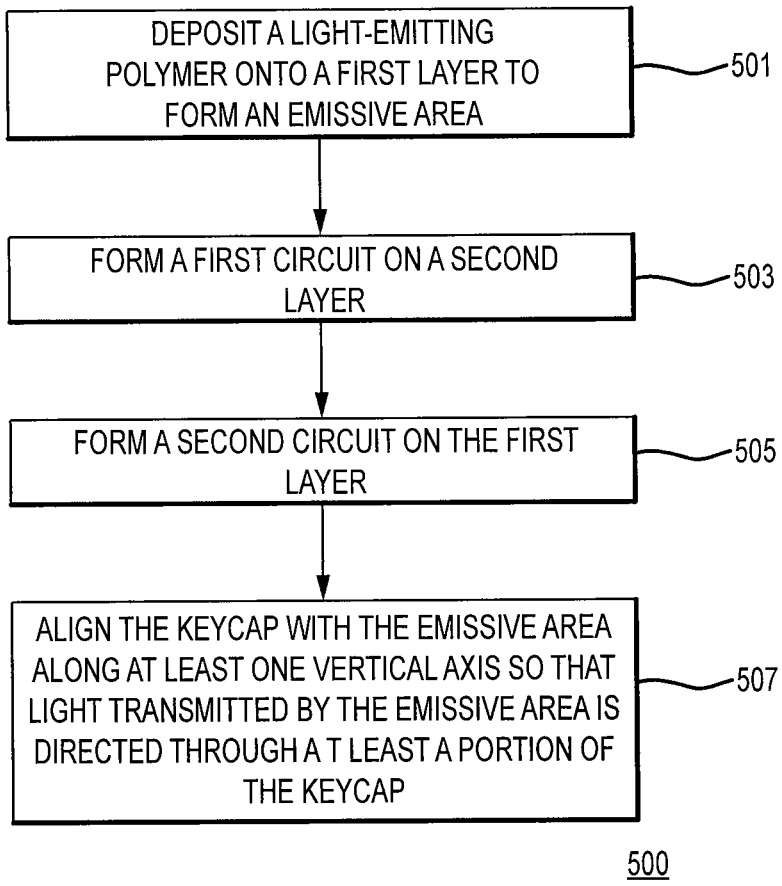
FIG. 5 is a flow chart illustrating operations of a method for manufacturing an illuminated keyboard.

FIG. 5 shows a flow chart illustrating operations of a method 500 for manufacturing an illuminated keyboard. In operation 501, the method may include depositing a light-emitting polymer onto a first layer to form an emissive area. As discussed above, the light-emitting polymer may be deposited onto a substrate layer of a light emissive layer so as to form an emissive pattern or design when illuminated. In operation 503, the method may include forming a first circuit on a second layer. In one embodiment, the first circuit may be deposited onto the encapsulation layer. In other embodiments, the first circuit may be deposited onto another layer of the keyboard, such as a metal layer or the substrate layer. In one embodiment, the first circuit may correspond to at least one key of the keyboard. The first circuit may be configured to transmit a command signal corresponding to the key when a dome switch is depressed onto the first circuit.

In operation 505, the method may include forming a second circuit on the first layer. As discussed above, the second circuit may be deposited onto the substrate layer. In one embodiment, the second circuit may be configured to transmit a voltage to the emissive areas of the keyboard. When connected to the voltage, the emissive areas may be illuminated. In operation 507, the method may include aligning at least a portion of the keycap with the emissive pattern along at least one vertical axis so that light transmitted by the emissive pattern is directed through at least a portion of the keycap. In one embodiment, the emissive pattern may be aligned along at least one vertical axis with the legend etched onto the outermost keycap surface, and the emissive pattern may have substantially the same shape as the legend. In another embodiment, the emissive pattern may have substantially the same shape as the top surface of the keycap. In alternate embodiments, the operations illustrated in the flow chart can be performed in a different order than that specified by the flow chart. For example, in one embodiment, forming the first circuit on the second layer may be performed after forming the second circuit on the first layer, and so on and so forth.

Other embodiments may include other configurations of illuminated keyboards or keypads that may be implemented in a variety of electronic devices including, but not limited to: a desktop computer; a portable computing device or mobile phone; remote control; appliance such as a refrigerator, microwave oven, and so on; and any other electronic device. Additionally, other embodiments may utilize other types of backlit visual display elements. For example, in one embodiment, a trackpad may be backlit. The trackpad may include an array of touch-sensitive elements with a corresponding backlight array including a plurality of emissive areas for illuminating locations in which the trackpad is touched by a user. Alternatively, the backlight array may illuminate locations in which the trackpad is not touched. As such, although the description included herein may include some specific embodiments and may be related to particular functions, it should be understood that the embodiments described herein may be implemented in a wide variety of devices and may perform a variety of functions.

What is claimed is:

1. A keyboard, comprising:

an illuminable key comprising:

a keycap;

a dome switch positioned below the keycap and comprising a flexible membrane and an electrically-conductive contact;

a light emissive layer positioned below the dome switch and comprising:

a substrate; and a film of light-emitting polymer formed on the substrate in a shape that corresponds to an area defined by or through the keycap;

an encapsulation layer positioned below the dome switch and over the film of light-emitting polymer, thereby encapsulating the film of light-emitting polymer;

a switch contact layer formed on or coupled to a top surface of the encapsulation layer and configured to transmit a signal corresponding to the illuminable key when the illuminable key is pressed and the flexible membrane of the dome switch compresses a distance sufficient for the electrically-conductive contact to touch the switch contact layer; and a power supply trace disposed on a bottom surface of the encapsulation layer, the power supply trace configured to supply a voltage to film of light-emitting polymer so that the film of light-emitting polymer generate and emit light toward the area defined by or through the keycap.

2. The keyboard of claim 1, wherein the encapsulation layer is transparent.

3. The keyboard of claim 1, wherein the shape of the film of light-emitting polymer is substantially identical to the area defined by or through the keycap.

4. The keyboard of claim 1, wherein the film of light-emitting polymer is aligned with the area defined by or through the keycap along a vertical axis such that light generated by the film of light-emitting polymer is directed upwardly through the area defined by or through the keycap.

5. The keyboard of claim 1, wherein the encapsulation layer is glass.

6. The keyboard of claim 1, wherein the area defined by or through the keycap defines a legend, and the shape of the film of light-emitting polymer is substantially identical to the shape of the legend.

7. The keyboard of claim 6, wherein the film of light-emitting polymer is aligned with the legend along a vertical axis such that light generated by the film of light-emitting polymer is directed upwardly toward and through the legend.

8. The keyboard of claim 1, wherein the switch contact layer is formed on the substrate layer.

9. The keyboard of claim 1, wherein the film of light-emitting polymer is formed to define a plurality of distinct and separated light emissive areas.

10. The keyboard of claim 1, wherein the film of light-emitting polymer comprises an organic light-emitting diode.

11. The keyboard of claim 1, wherein the film of light-emitting polymer covers only a portion of the light emissive layer.

12. A method for manufacturing a light emissive layer for illuminating a keyboard, comprising:

depositing a film of light-emitting polymer onto a first surface of a substrate to form a plurality of distinct and separate light-generating areas;

depositing an encapsulation layer on the substrate and over the plurality of distinct and separate light-generating areas;

forming a first circuit on an external surface of the encapsulation layer opposite the plurality of distinct and separate light-generating areas, the first circuit configured to transmit a signal corresponding to a keycap when the keycap is pressed by a user; and forming a second circuit on the first surface of the substrate, the second circuit coplanar with the plurality of distinct and separate light-generating areas and configured to supply a voltage to each of the plurality of distinct and separate light-generating areas to cause each of the plurality of distinct and separate light-generating areas to generate and emit light.

13. The method of claim 12, further comprising:

aligning the keycap with at least one of the plurality of distinct and separate light-generating areas along a vertical axis such that light generated thereby is directed toward at least a portion of the keycap.

14. The method of claim 12, wherein the substrate is glass.

15. A keyboard, comprising:

a keycap;

a light-generating layer underlying the keycap, the light-generating layer comprising:

a substrate;

a power circuit formed onto the substrate;

a light-emitting polymer deposited onto the substrate and connected to the power circuit, the light-emitting polymer deposited so as to define a first and a second discrete light-generating area, the first and second discrete light-generating areas each covering only a portion of the substrate, the first discrete light-generating area formed into a shape corresponding to an area defined by or within the keycap; and an encapsulation sheet disposed over the light-emitting polymer, thereby encapsulating the first and the second discrete light-generating areas;

a switch circuit disposed on a surface of the encapsulation sheet opposite the light-emitting polymer, the switch circuit configured to transmit a signal corresponding to the keycap when the keycap is pressed by a user; and a dome switch underlying the first discrete light-generating area and aligned with the keycap.

16. The keyboard of claim 15, wherein the first and second discrete light light-generating areas are flexible organic light-emitting diodes.

17. The keyboard of claim 15, wherein the keycap defines a legend and the first discrete light-generating area is aligned with the legend along a vertical axis such that light generated by the first discrete light-generating area is directed upwardly through the legend.

18. A keyboard, comprising:

a plurality of keys, each key comprising:

a keycap;

a dome switch underlying the keycap;

an encapsulation sheet comprising:

a top surface oriented toward the keycap, the top surface comprising a switch circuit underlying the keycap; and a bottom surface opposite the top surface;

a light-generating area disposed onto a top surface of a substrate, the light-generating area positioned to interface the bottom surface of the encapsulation sheet so as to underlay the keycap and such that the light-generating area is encapsulated by the encapsulation sheet; and a power circuit disposed on the substrate and electrically coupled to the light-generating area and configured to provide electrical power to the light-generating area.

* * * * *